US012235076B2

(12) United States Patent
Davis

(10) Patent No.: US 12,235,076 B2
(45) Date of Patent: Feb. 25, 2025

(54) LOCKING ADJUSTMENT DEVICE

(71) Applicant: Leupold & Stevens, Inc., Beaverton, OR (US)

(72) Inventor: Matthew C. Davis, Beaverton, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 40 days.

(21) Appl. No.: 18/140,794

(22) Filed: Apr. 28, 2023

(65) Prior Publication Data

US 2024/0361103 A1 Oct. 31, 2024

(51) Int. Cl.
*F41G 1/38* (2006.01)
*F41G 1/54* (2006.01)

(52) U.S. Cl.
CPC ..... *F41G 1/38* (2013.01); *F41G 1/545* (2013.01)

(58) Field of Classification Search
CPC ..... F41G 1/38; F41G 1/545
USPC ..... 42/122
See application file for complete search history.

(56) References Cited

U.S. PATENT DOCUMENTS

| | | | |
|---|---|---|---|
| 680,442 | A | 8/1901 | Schmitt |
| 1,344,973 | A | 6/1920 | Bader |
| 2,143,167 | A | 1/1939 | Pechar |
| 2,165,796 | A | 7/1939 | Humeston |
| 2,208,913 | A | 7/1940 | Unertl |
| 2,229,637 | A | 1/1941 | Burton |
| 2,336,107 | A | 12/1943 | Litschert |
| 2,452,592 | A | 11/1948 | Meyer |
| 2,583,042 | A | 1/1952 | Dayton |
| 2,585,933 | A | 2/1952 | Harvey |
| 2,682,707 | A | 7/1954 | Dahlberg |
| 2,704,466 | A | 3/1955 | Way |
| 2,833,158 | A | 5/1958 | Damon |

(Continued)

FOREIGN PATENT DOCUMENTS

| | | | | |
|---|---|---|---|---|
| CA | 3126257 A1 * | 7/2020 | ..... | F41G 1/38 |
| CN | 2752794 Y | 1/2006 | | |

(Continued)

OTHER PUBLICATIONS

Army Concept Team in Vietnam, Use of Night Vision Devices by US army Units in Vietnam (U), ACTIV Project No. ACG-25F Final Report—Night Vision Devices, dated Nov. 30, 1966, 66 pages.

(Continued)

*Primary Examiner* — Samir Abdosh
(74) *Attorney, Agent, or Firm* — Schwabe, Williamson & Wyatt, P.C.

(57) ABSTRACT

Various embodiments described herein may include a locking adjustment device having: a knob assembly being manually rotatable to adjust an optical device setting; a catch assembly defining a home position of the knob assembly whereat the catch assembly prevents rotation of the knob assembly in a clockwise or counterclockwise direction; and wherein the catch assembly includes a button or other lock-release arranged to, responsive to a manually-applied force, disengage a catch member from a catch opening or recess to allow the knob assembly to be rotated, in the clockwise or counterclockwise direction, from the home position to an adjustment position. Other embodiments may be disclosed and/or claimed.

20 Claims, 15 Drawing Sheets

(56) References Cited

U.S. PATENT DOCUMENTS

| | | | | |
|---|---|---|---|---|
| 2,913,826 | A | 11/1959 | Petty | |
| 3,037,287 | A | 6/1962 | Glatz et al. | |
| 3,058,391 | A | 10/1962 | Leupold | |
| 3,161,716 | A | 12/1964 | Burris et al. | |
| 3,222,987 | A | 12/1965 | Wrigglesworth | |
| 3,280,463 | A | 10/1966 | Stadler | |
| 3,297,389 | A | 1/1967 | Gibson | |
| 3,471,932 | A | 10/1969 | Luning | |
| 3,662,618 | A | 5/1972 | Kroll et al. | |
| 3,707,204 | A | 12/1972 | Dussardier | |
| 3,826,012 | A | 7/1974 | Pachmayr | |
| 3,916,721 | A | 11/1975 | Egger | |
| 3,990,155 | A | 11/1976 | Akin, Jr. et al. | |
| 3,999,442 | A | 12/1976 | Decker et al. | |
| 4,012,966 | A | 3/1977 | Lieberman et al. | |
| 4,026,397 | A | 5/1977 | Raus | |
| 4,038,757 | A | 8/1977 | Hicks et al. | |
| 4,132,129 | A | 1/1979 | Pratt | |
| 4,154,125 | A | 5/1979 | Frank | |
| 4,200,355 | A | 4/1980 | Williams, Jr. | |
| 4,201,096 | A | 5/1980 | Morrison et al. | |
| 4,240,201 | A | 12/1980 | Sawby et al. | |
| 4,247,161 | A | 1/1981 | Unertl, Jr. | |
| 4,300,525 | A | 11/1981 | Delgado et al. | |
| 4,347,758 | A | 9/1982 | Geil et al. | |
| 4,373,269 | A | 2/1983 | Doliber et al. | |
| 4,389,791 | A | 6/1983 | Ackerman | |
| 4,408,842 | A | 10/1983 | Gibson | |
| 4,457,076 | A | 7/1984 | Heck | |
| 4,461,330 | A | 7/1984 | Judkins | |
| 4,643,542 | A | 2/1987 | Gibson | |
| 4,779,305 | A | 10/1988 | Gorsek | |
| 4,818,086 | A | 4/1989 | Moore | |
| 4,955,253 | A | 9/1990 | Sakai et al. | |
| 4,982,502 | A | 1/1991 | Weyrauch | |
| 5,020,389 | A | 6/1991 | Sigler | |
| 5,083,477 | A | 1/1992 | Geil | |
| 5,121,653 | A | 6/1992 | Sigler | |
| 5,152,187 | A | 10/1992 | LaFemina | |
| 5,329,829 | A | 7/1994 | Sell | |
| 5,363,559 | A | 11/1994 | McCarty | |
| 5,433,010 | A | 7/1995 | Bell | |
| 5,499,456 | A | 3/1996 | Tomita | |
| 5,513,440 | A | 5/1996 | Murg | |
| 5,586,569 | A | 12/1996 | Hanning et al. | |
| 5,615,487 | A | 4/1997 | Tomita | |
| 5,618,374 | A | 4/1997 | Byerley | |
| 5,695,125 | A | 12/1997 | Kumar | |
| 5,715,607 | A | 2/1998 | Murg | |
| 5,745,287 | A | 4/1998 | Sauter | |
| 5,771,595 | A | 6/1998 | Bell | |
| 5,862,715 | A | 1/1999 | Lemire | |
| 5,892,617 | A | 4/1999 | Wallace | |
| 5,906,141 | A | 5/1999 | Abdelmoula | |
| 5,930,934 | A | 8/1999 | Fisher et al. | |
| 6,005,711 | A | 12/1999 | Mai et al. | |
| 6,279,259 | B1 | 8/2001 | Otteman | |
| 6,351,907 | B1 | 3/2002 | Otteman | |
| 6,442,854 | B1 | 9/2002 | Liu et al. | |
| 6,508,144 | B1 | 1/2003 | Vendetti et al. | |
| 6,519,890 | B1 | 2/2003 | Otteman | |
| 6,588,125 | B2 | 7/2003 | Proctor, Sr. | |
| 6,643,970 | B2 | 11/2003 | Huber | |
| 6,691,447 | B1 * | 2/2004 | Otteman | F41G 1/38 42/129 |
| 6,705,037 | B2 | 3/2004 | Van Kirk | |
| 6,721,095 | B2 | 4/2004 | Huber | |
| 6,772,550 | B1 | 8/2004 | Leatherwood | |
| 6,848,628 | B2 | 2/2005 | Walker | |
| 6,860,442 | B2 | 3/2005 | Datcuk, Jr. | |
| 6,862,832 | B2 | 3/2005 | Barrett | |
| 7,117,624 | B2 | 10/2006 | Kim | |
| 7,121,037 | B2 | 10/2006 | Penney | |
| 7,330,310 | B2 | 2/2008 | Hengst et al. | |
| 7,612,952 | B2 | 11/2009 | Schafer | |
| 7,640,830 | B2 | 1/2010 | Bonis | |
| 7,997,163 | B2 * | 8/2011 | Casas | F41G 1/44 74/553 |
| 8,006,429 | B2 | 8/2011 | Windauer | |
| 8,205,762 | B2 | 6/2012 | Carroll | |
| 8,270,104 | B2 | 9/2012 | Windauer | |
| 8,407,927 | B2 * | 4/2013 | Huber | F41G 1/38 359/405 |
| 8,516,736 | B2 | 8/2013 | Windauer | |
| 8,806,798 | B2 * | 8/2014 | Crispin | F41G 1/38 74/553 |
| 8,984,796 | B2 | 3/2015 | Thomas et al. | |
| 9,170,068 | B2 * | 10/2015 | Crispin | F41G 1/38 |
| 9,182,773 | B2 | 11/2015 | Campean | |
| 9,188,408 | B2 | 11/2015 | Huynh | |
| 9,292,034 | B2 | 3/2016 | Windauer | |
| RE46,011 | E * | 5/2016 | Huber | F41G 1/38 |
| 9,435,609 | B2 | 9/2016 | Hamilton | |
| 9,665,120 | B2 | 5/2017 | Windauer | |
| 9,823,684 | B2 | 11/2017 | Finley et al. | |
| 10,101,122 | B2 | 10/2018 | Davidson et al. | |
| 10,132,593 | B2 | 11/2018 | White et al. | |
| 10,190,848 | B2 | 1/2019 | VanBecelaere | |
| 10,190,849 | B1 * | 1/2019 | Webber | F41G 1/545 |
| 10,302,394 | B2 * | 5/2019 | Ding | F41G 1/38 |
| 10,309,749 | B2 | 6/2019 | Hamilton | |
| 10,337,831 | B2 | 7/2019 | Lin et al. | |
| 10,578,399 | B2 | 3/2020 | Crispin | |
| 10,900,747 | B2 | 1/2021 | Kilic | |
| 11,243,049 | B1 | 2/2022 | Enzinger | |
| 11,255,636 | B2 | 2/2022 | Crispin | |
| 11,530,899 | B2 * | 12/2022 | Sheets, Jr. | G02B 27/36 |
| 2003/0140545 | A1 | 7/2003 | Huber | |
| 2004/0088898 | A1 | 5/2004 | Barrett | |
| 2006/0254115 | A1 | 11/2006 | Thomas et al. | |
| 2006/0268433 | A1 | 11/2006 | Thomas | |
| 2006/0278035 | A1 | 12/2006 | Casas | |
| 2007/0240356 | A1 | 10/2007 | Klepp et al. | |
| 2008/0066364 | A1 | 3/2008 | Klepp et al. | |
| 2008/0236018 | A1 | 10/2008 | Halverson | |
| 2009/0044660 | A1 | 2/2009 | Bonis | |
| 2009/0199452 | A1 | 8/2009 | Huber | |
| 2009/0205461 | A1 | 8/2009 | Windauer | |
| 2010/0175298 | A1 | 7/2010 | Thomas et al. | |
| 2011/0061285 | A1 | 3/2011 | Hamilton | |
| 2011/0100152 | A1 | 5/2011 | Huynh | |
| 2012/0030988 | A1 | 2/2012 | Windauer | |
| 2016/0123704 | A1 | 5/2016 | Crispin | |
| 2017/0191797 | A1 | 7/2017 | Lassak et al. | |
| 2017/0205195 | A1 | 7/2017 | Sheets, Jr. et al. | |
| 2019/0072363 | A1 | 3/2019 | Kilic | |
| 2019/0128642 | A1 | 5/2019 | Davis et al. | |
| 2019/0376765 | A1 * | 12/2019 | Hamilton | F41G 1/38 |
| 2020/0232763 | A1 * | 7/2020 | Sheets, Jr. | G02B 23/14 |
| 2020/0271415 | A1 | 8/2020 | Crispin | |
| 2022/0373296 | A1 | 11/2022 | Cheng | |
| 2024/0085150 | A1 * | 3/2024 | Davis | F41G 1/38 |

FOREIGN PATENT DOCUMENTS

| | | | |
|---|---|---|---|
| DE | 2148967 | | 4/1973 |
| DE | 29720737 | U1 | 2/1998 |
| DE | 29903989 | U | 7/1999 |
| DE | 20301749 | U | 4/2003 |
| DE | 10222528 | A1 | 12/2003 |
| DE | 202006003770 | U1 | 6/2006 |
| EP | 0271982 | A2 | 6/1988 |
| GB | 598306 | | 2/1945 |
| GB | 708438 | | 5/1954 |
| GB | 1102022 | | 2/1968 |
| GB | 1214584 | | 12/1970 |
| GB | 2213959 | A | 8/1986 |
| JP | 11085290 | | 3/1999 |
| JP | 2003222499 | A | 8/2003 |
| JP | 2004150699 | A | 5/2004 |
| WO | 2006060490 | A2 | 6/2006 |
| WO | 2006109587 | A1 | 10/2006 |

(56) References Cited

FOREIGN PATENT DOCUMENTS

| | | | |
|---|---|---|---|
| WO | 2010008810 | A2 | 1/2010 |
| WO | 2013102869 | A1 | 7/2013 |
| WO | 2013102872 | A1 | 7/2013 |

OTHER PUBLICATIONS

Article: Bayonet Mount, Answers.com Encyclodistionalmanacapedia, http://www.answers.com/topic/bayonet-mount, visited Sep. 28, 2006, 2 pages.

Canon, Inc., Digital Video Camcorder Instruction Manual for model LX2, 2004 (date of publication unknown), 10 pages.

Canon, Inc., Digital Video Camcorder Instruction Manual for model LX2, 2004 (date of publication unknown), pp. 1, 6, 7, 9-11, 32, 43, 55, 56 and 126.

International Search Report and Written Opinion, International Application No. PCT/US2013/020062, dated Apr. 25, 2013, 11 pages.

International Search Report and Written Opinion, International Patent Application No. PCT/US05/43336, dated Jul. 7, 2008, 4 pages.

Leupold & Stevens, Inc., Complaint for Patent Infringement, *Leupold & Stevens, Inc.* v. *Lightforce USA, Inc.*, Case No. 3:16-cv-1570-HZ (D. Or.), Aug. 2, 2016, 15 pages.

Leupold & Stevens, Inc., Declaration of David Byron in Support of Leopold's Response to Nightforce's Supplemental Claim Construction Brief, *Leupold & Stevens, Inc.* v. *Lightforce USA, Inc.*, Case No. 3:16-cv-01570-HZ (D. Or.) Mar. 17, 2021, 19 pages.

Leupold & Stevens, Inc., Plaintiff's Opening Claim Construction Brief [Redacted Public Version], *Leupold & Stevens, Inc.* v. *Lightforce USA, Inc.*, Case No. 3:16-cv-01570-HZ (D. Or.), Feb. 11, 2021, 41 pages.

Leupold & Stevens, Inc., Plaintiff's Response to Defendant's Supplemental Claim Construction Brief [Redacted Version], *Leupold & Stevens, Inc.* v. *Lightforce USA, Inc.*, Case No. 3:16-cv-01570-HZ (D. Or.), Mar. 18, 2021, 44 pages.

Leupold & Stevens, Inc., Supplemental Declaration of David Byron Regarding Claim Constructions, *Leupold & Stevens, Inc.* v. *Lightforce USA, Inc.*, Case No. 3: 16-cv-01570-HZ (D. Or.), Feb. 11, 2021, 13 pages.

Lightforce USA, Inc., Answer to Plaintiff's Complaint and Defendant's Counterclaims, *Leupold & Stevens, Inc.* v. *Lightforce USA, Inc.*, Case No. 3:16-cv-1570-HZ (D. Or.), Dec. 6, 2016, 20 pages.

Lightforce USA, Inc., Declaration of Arie Pellikaan in Support of Nightforce's Supplemental Claim Construction Brief Pursuant to ECF No. 241, *Leupold & Stevens, Inc.* v. *Lightforce USA, Inc.*, Case No. 3: 16-cv-01570-HZ (D. Or.), Feb. 11, 2021, 3 pages.

Lightforce USA, Inc., Declaration of Douglas P. DuFaux in Support of Nightforce's Supplemental Claim Construction Brief Pursuant to ECF No. 241, *Leupold & Stevens, Inc.* v. *Lightforce USA, Inc.*, Case No. 3:16-cv-01570-HZ (D. Or.), Feb. 11, 2021, 11 pages.

Lightforce USA, Inc., Defendant's Third Supplemental Rule 26(a)(2)C) Disclosure (Turret Knob Patents), *Leupold & Stevens, Inc.* v. *Lightforce USA, Inc.*, Case No. 3: 16-cv-01570-HZ (D. Or.), Dec. 31, 2020, 21 pages.

Lightforce USA, Inc., Expert Report of Doublas P. DuFaux, *Leupold & Stevens, Inc.* v. *Lightforce USA, Inc.*, Case No. 3:16-cv-1570-HZ (D. Or.) Aug. 24, 2018, 91 pgaes.

Lightforce USA, Inc., Lightforce USA, Inc. Non-Infringement and Invalidity/Unenforceability Contentions (redacted), *Leupold & Stevens, Inc.* v. *Lightforce USA, Inc.*, Case No. 3:16-cv-1570-HZ (D. Or.), Mar. 15, 2017, 36 pages.

Lightforce USA, Inc., Lightforce USA, Inc.'s Supplemental Invalidity/Unenforceability Contentions for Counts I Through VIII; and Supplemental Non-Infringement Contentions for Counts I Through VIII, *Leupold & Stevens, Inc.* v. *Lightforce USA, Inc.*, Case No. 3:16-cv-01570-HZ (D. Or.), Mar. 5, 2018, 293 pages.

Lightforce USA, Inc., Nightforce's Response to Plaintiff's Opening Claim Construction Brief, *Leupold & Stevens, Inc.* v. *Lightforce USA, Inc.*, Case No. 3:16-cv-01570-HZ (D. Or.), Mar. 17, 2021, 21 pages.

Lightforce USA, Inc., Nightforce's Supplemental Claim Contruction Brief Pursuant to ECF No. 241, *Leupold & Stevens, Inc.* v. *Lightforce USA, Inc.*, Case No. 3:16-cv-01570-HZ (D. Or.), Feb. 11, 2021, 40 pages.

United States District Court for the District of Oregon, Opinion and Order, *Leupold & Stevens, Inc.* v. *Lightforce USA, Inc.*, Case No. 3:16-cv-01570-HZ (D. Or.), Jan. 31, 2018, 30 pages.

United States District Court for the District of Oregon, Opinion and Order, *Leupold & Stevens, Inc.* v. *Lightforce USA, Inc.*, Case No. 3:16-cv-01570-HZ (D. Or.), Nov. 17, 2020, 63 pages.

European Patent Office, International Search Report and Written Opinion of the International Searching Authority in PCT/US2024/026096, mailed Jun. 17, 2024, 11 pages.

* cited by examiner (background)

LOCKING ADJUSTMENT DEVICE

RELATED APPLICATION

The subject matter described in this application is related to U.S. patent application Ser. No. 17/651,789, filed Feb. 18, 2022 and entitled "LOCKING ADJUSTMENT DEVICE," which is a continuation of U.S. patent application filed Ser. No. 16/807,051, filed Mar. 2, 2020 (now U.S. Pat. No. 11,255,636) and entitled "LOCKING ADJUSTMENT DEVICE," which is a continuation of U.S. patent application Ser. No. 14/923,158, filed Oct. 26, 2015 (now U.S. Pat. No. 10,578,399) and entitled "LOCKING ADJUSTMENT DEVICE," which is a continuation of U.S. patent application Ser. No. 13/343,656 filed Jan. 4, 2012 (now U.S. Pat. No. 9,170,068) and entitled "LOCKING ADJUSTMENT DEVICE," the disclosures of which are incorporated by reference herein in their entireties.

TECHNICAL FIELD

The field of the present disclosure relates generally to rotating adjustment mechanisms, and in particular, to a rotatable assembly for actuating an optical or electrical element of a sighting device, such as a riflescope, a telescope, or other aimed optical device.

BACKGROUND

Sighting devices such as riflescopes have long been used in conjunction with weapons and firearms, such as rifles, handguns, and crossbows, to allow a shooter to accurately aim at a selected target. Because bullet and arrow trajectory, wind conditions, and distance to the target can vary depending upon shooting conditions, quality sighting devices typically provide compensation for variations in these conditions by allowing a shooter to make incremental adjustments to the optical characteristics or the aiming of the sighting device relative to the weapon surface on which it is mounted. These adjustments are known as elevation and windage adjustments, and are typically accomplished by lateral movement of an adjusting member, such as a reticle located within the riflescope, as shown in U.S. Pat. No. 3,058,391 of Leupold, or movement of one or more lenses within a housing of the riflescope, as shown in U.S. Pat. Nos. 3,297,389 and 4,408,842 of Gibson, and U.S. Pat. No. 7,827,723 of Zaderey et al.

The shooter typically makes such adjustments using rotatable adjustment knobs to actuate the adjustable member of the sighting device. Rotatable knobs may also be used to adjust other features of riflescopes, binoculars, spotting scopes, or other suitable optical devices, such as parallax, focus, illumination brightness, or other suitable features. Although the rotatable knobs are described in relation to use with sighting devices, rotatable knobs may be used to adjust an adjustable portion of other devices, and may include volume control knobs, channel selection knobs, radio station selection knobs, and other suitable knobs.

Some sighting devices with rotatable knobs may include a locking device to prevent inadvertent rotation of the knob. For example, one known locking device for a rotatable knob includes two buttons on opposite sides of the knob that must be squeezed together to unlock the knob for rotation and thereby enable a desired adjustment. When the buttons are released, the knob is immediately locked at its current rotational position. One drawback of this locking device is its relative complexity and attendant expense of manufacture. The squeezing pressure required to unlock the knob for rotation may also make it more difficult to effect multiple fine rotation adjustments in the course of an aiming operation, when inadvertent rotation of the knob is less of a concern.

The '636 patent describes a locking adjustment device that addresses at least some of the above drawbacks. Very briefly, this locking adjustment device may include a button or other lock-release. The button or other lock-release is operably associated with a guide tab and manually depressible to urge guide tab out of a locked position and thereby allow a knob to be manually rotated about the turret axis away from the locked position. Although the '636 patent is incorporated by reference herein, some of the information contained in the '636 patent is also repeated in the next eight paragraphs, with reference to FIG. 1 of the present application, to provide background.

Referring now to FIG. 1, the locking adjustment device may be mounted to a main tube 102 of a riflescope 38. Within main tube 102, at least one adjustable element, such as a reticle, lens assembly, or other optical or electrical elements, may be movably mounted in a substantially perpendicular orientation relative to a longitudinal tube axis 104. Main tube 102 further includes a seat 106, which has a bore 108 sized to receive a locking adjustment device. Bore 108 may include threads 110 formed on an interior wall or shoulder of bore 108 that may mate with corresponding threads 112 on a retaining ring 114 or another structure of locking adjustment device, such as a spindle 116, to secure locking adjustment device to main tube 102 when locking adjustment device is installed. Bore 108 further includes a slot or aperture 118 formed at a base 120 and sized to receive a threaded plunger 122 via an end 126 of plunger 122. Plunger 122 includes threads 128 sized to mesh with interior threads on an interior bore of spindle 116 so that plunger 122 may be threadably coupled to spindle 116.

Plunger 122 extends into main tube 102 and is constrained from rotating so that rotation of spindle 116 (into which plunger 122 is threaded) about the turret axis is translated into linear motion of plunger 122 along the turret axis, thereby adjusting a position of the adjustable element within main tube 102.

Spindle 116 includes a lower base portion 134 and an upper neck portion 136, which may be is smaller in diameter than lower base portion 134. Retaining ring 114 surrounds spindle 116 and retains spindle 116 against seat 106 of the riflescope 138. Retaining ring 114 includes exterior threads 112 sized to mesh with threads 110 on bore 108. Thus, spindle 116 is captured against main tube 102 and allowed to rotate about the turret axis, but is constrained from traveling along the turret axis by retaining ring 114, which is threaded into bore 108 of main tube 102. Retaining ring 114 includes a pair of blind bores 142 sized to fit a spanner wrench for threading and tightening retaining ring 114 onto spindle 116 or into bore 108, or both.

The locking adjustment device may include a click mechanism 146 to provide tactile and/or audible feedback to the user when a knob 174 is rotated. Click mechanism 146 may include a click ring 148 interposed between a shoulder of the lower base portion 134 of spindle 116 and retaining ring 114. Click ring 148 includes a grooved surface 152 facing spindle 116. Grooved surface 152 includes regularly spaced apart features, which may include splines or a series of evenly spaced vertical grooves or ridges. Other engagement features may include a series of detents, indentations, apertures, or other suitable features. Click mechanism 146 further includes a click pin 154 with a ramped surface 156 configured to engage the regularly spaced apart features of grooved surface 152. Click pin 154 is housed within a bore 158 in spindle 116 that has an open end facing grooved surface 152. A spring 160, or other biasing element, urges click pin 154 to extend outwardly from within bore 158 and engage grooved surface 152 of click ring 148. In operation, rotational movement of knob 174 about the turret axis causes click pin 154 to move out of contact with one groove and into a neighboring groove, thereby producing a click that is either audible, tactile, or both. Each click may coincide with an adjustment amount to alert the user about the extent of an adjustment being made. Click mechanism 146 continues clicking as long as knob 174 is rotated.

Locking adjustment device may further include a guide ring 168 attached along a stepped portion of an upper necked portion 172 of retaining ring 114. Guide ring 168 may be press fit around retaining ring 114 such that it rests flush against stepped portion and upper necked portion 172. In some embodiments, guide ring 168 may be welded, threaded, or adhered by an adhesive substance to retaining ring 114. In other embodiments, guide ring 168 may be integrated with or formed in retaining ring 114 or main tube 102.

The locking adjustment device may include a knob 174 mountable over guide ring 168 and spindle 116 for rotation about the turret axis when locking adjustment device is installed on riflescope 138. Knob 174 may include a retaining cap and a dial. Retaining cap may include a cylindrical gripping surface that may be notched, fluted, knurled, or otherwise textured to provide a surface for the user to grip when manually rotating knob 174. Dial may be supplied with a fine scale composed of parallel longitudinal indicia spaced apart around the circumference of dial to facilitate fine adjustments. Retaining cap and dial may be fabricated as a single unitary part or may be formed from two separate components that are coupled together, such as via mating threads.

The knob 174 may include a threaded bore sized to receive a threaded set screw. It should be understood that any number of bores, with a corresponding number of set screws, may be provided on knob 174. The set screw may rigidly couple knob 174 to a collar 188 that is press-fit onto upper neck portion 136 of spindle 116 so that knob 174 and spindle 116 rotate together as a unit. In other embodiments (not shown), collar 188 may be omitted and knob 174 may be directly coupled to spindle 116 by set screws or otherwise. A tool, such as a hex key, can be used to tighten set screw such that set screw bears against collar 188. Similarly, the tool can be used to loosen a set screw so that knob 174 and/or dial can be rotated relative to spindle 116 about the turret axis or removed and replaced with a different knob 174, if desired. In other embodiments (not shown), knob 174 is coupled or releasably coupled to spindle 116 in a manner other than by set screws. The combination of collar 188 and set screws, in conjunction with a flanged portion on collar 188, help prevent knob 174 from lifting upward in a direction along the turret axis.

The knob 174 may include a button 194 and an indicator unit 196 for rotation therewith. Slot 144 is sized and dimensioned to slidably receive indicator unit 196 such that at least a portion of indicator unit 196 is visible on a top surface of knob 174. Button 194 is operably associated with a guide tab 198 and manually depressible to urge guide tab 198 out of a locked position and thereby allow knob 174 to be manually rotated about the turret axis away from the locked position.

BRIEF DRAWINGS DESCRIPTION

The accompanying drawings, wherein like reference numerals represent like elements, are incorporated in and constitute a part of this specification and, together with the description, explain the advantages and principles of the presently disclosed technology.

DETAILED DESCRIPTION

With reference to the drawings, this section describes particular embodiments and their detailed construction and operation. Throughout the specification, reference to "one embodiment." "an embodiment," or "some embodiments" means that a particular described feature, structure, or characteristic may be included in at least one embodiment. Thus appearances of the phrases "in one embodiment." "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2A:
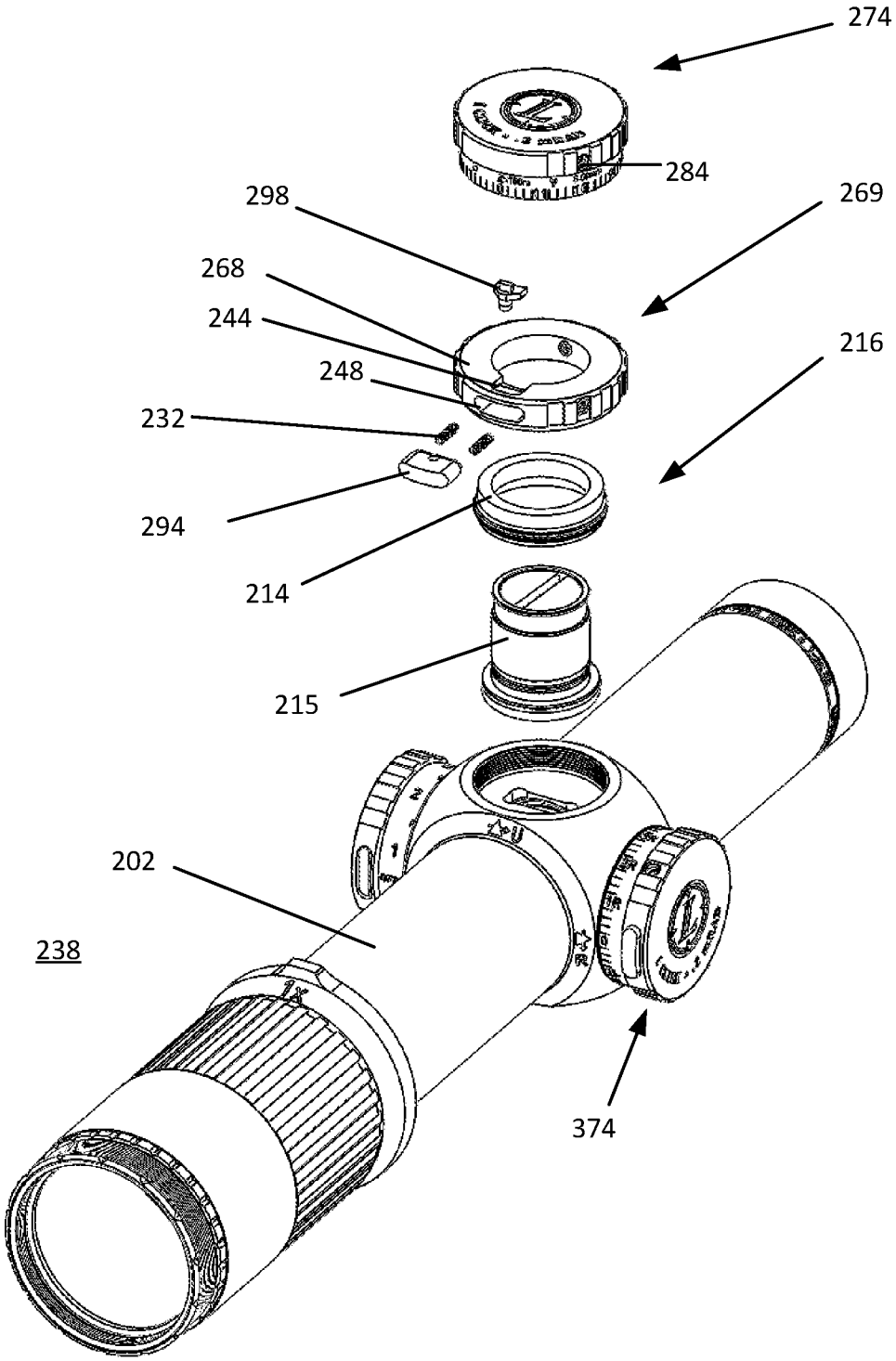
FIGS. 2A and 2B illustrate isometric views of a riflescope having an adjustment assembly coupled thereto, in which the adjustment assembly and its locking device are both shown in an exploded view, according to various embodiments.
Figure 2B:
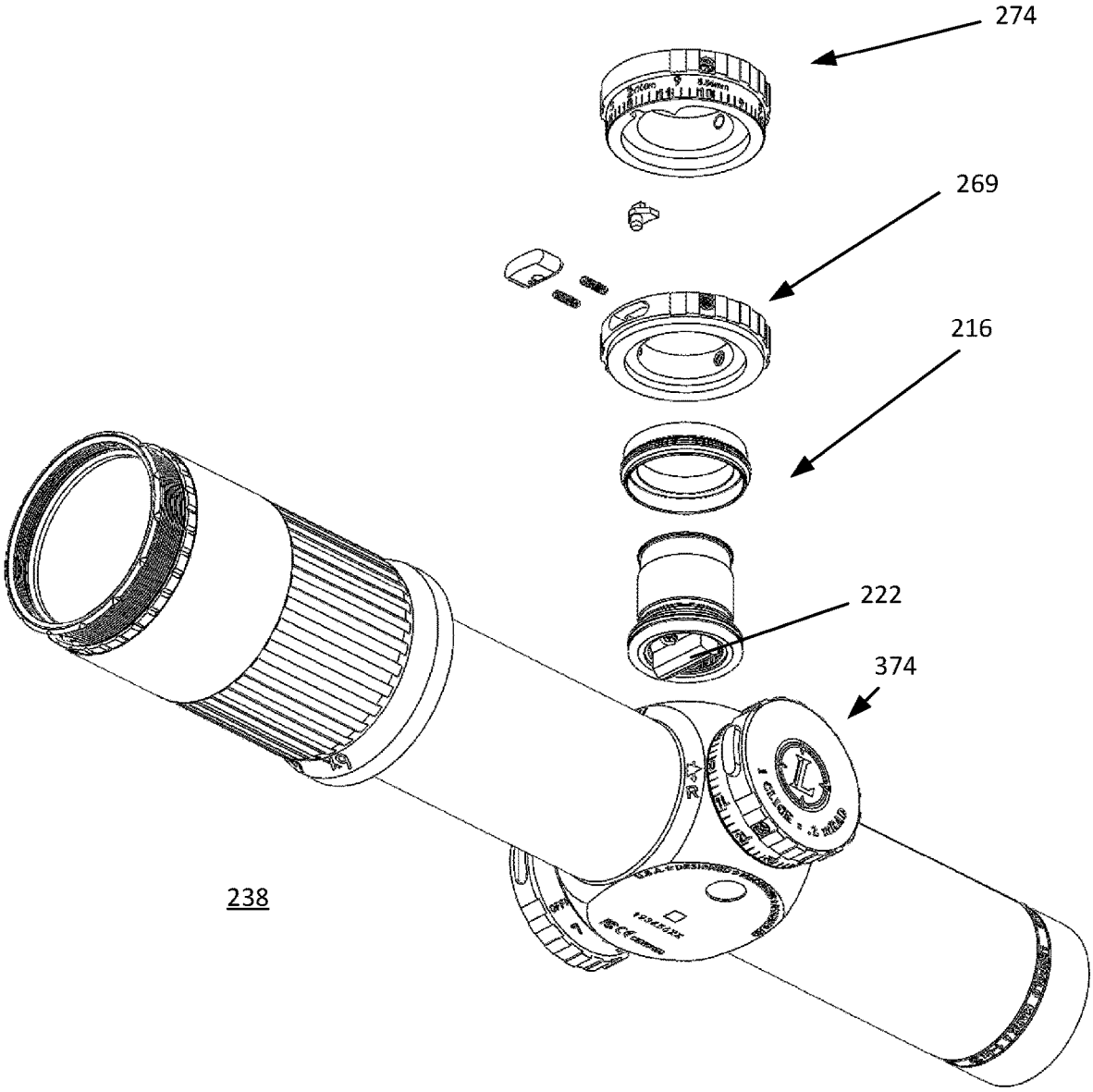
Figure 3A:
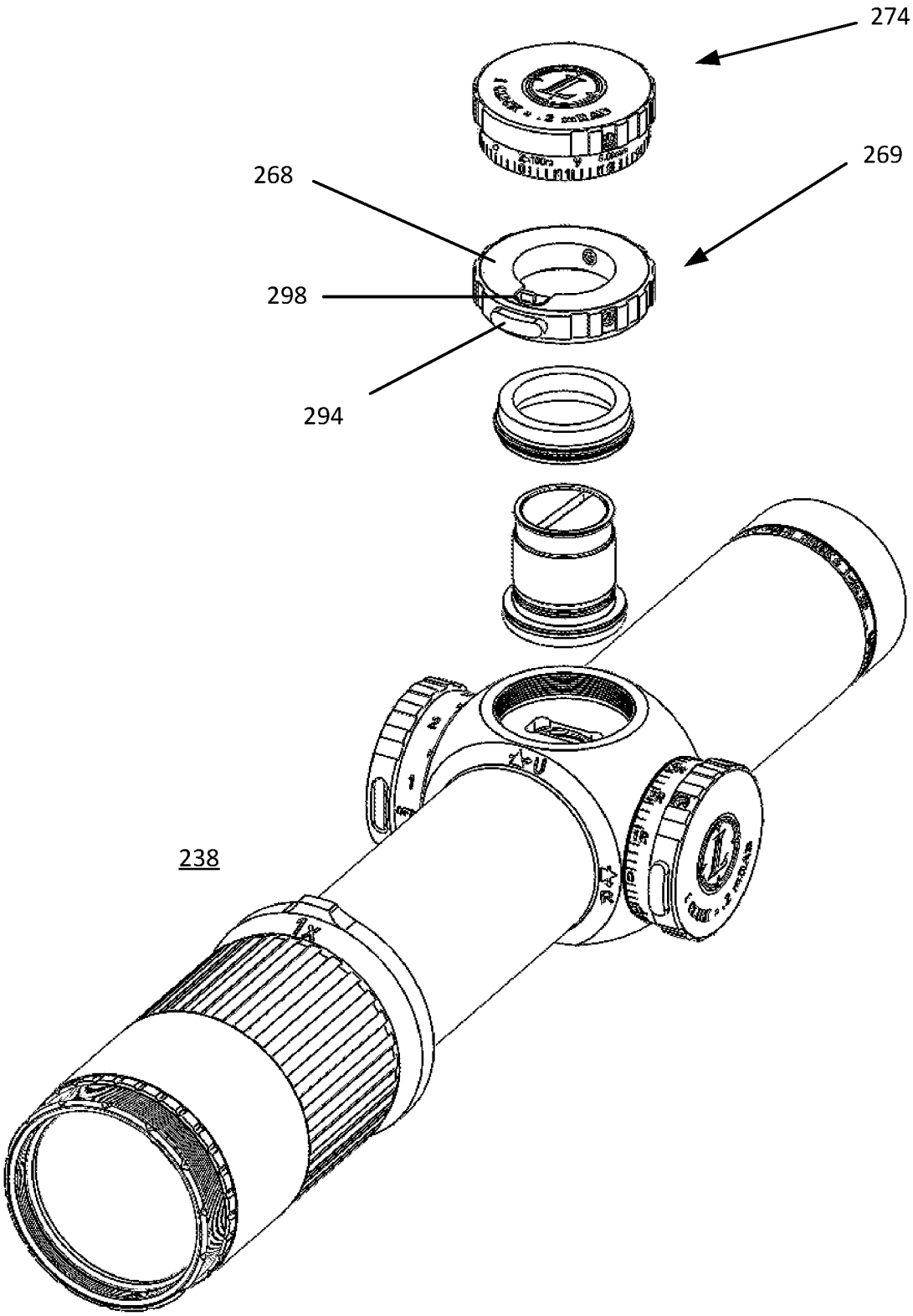
FIGS. 3A and 3B illustrate isometric views of the riflescope of FIGS. 2A and 2B in which the adjustment assembly is shown in an exploded view with its locking device installed.
Figure 3B:
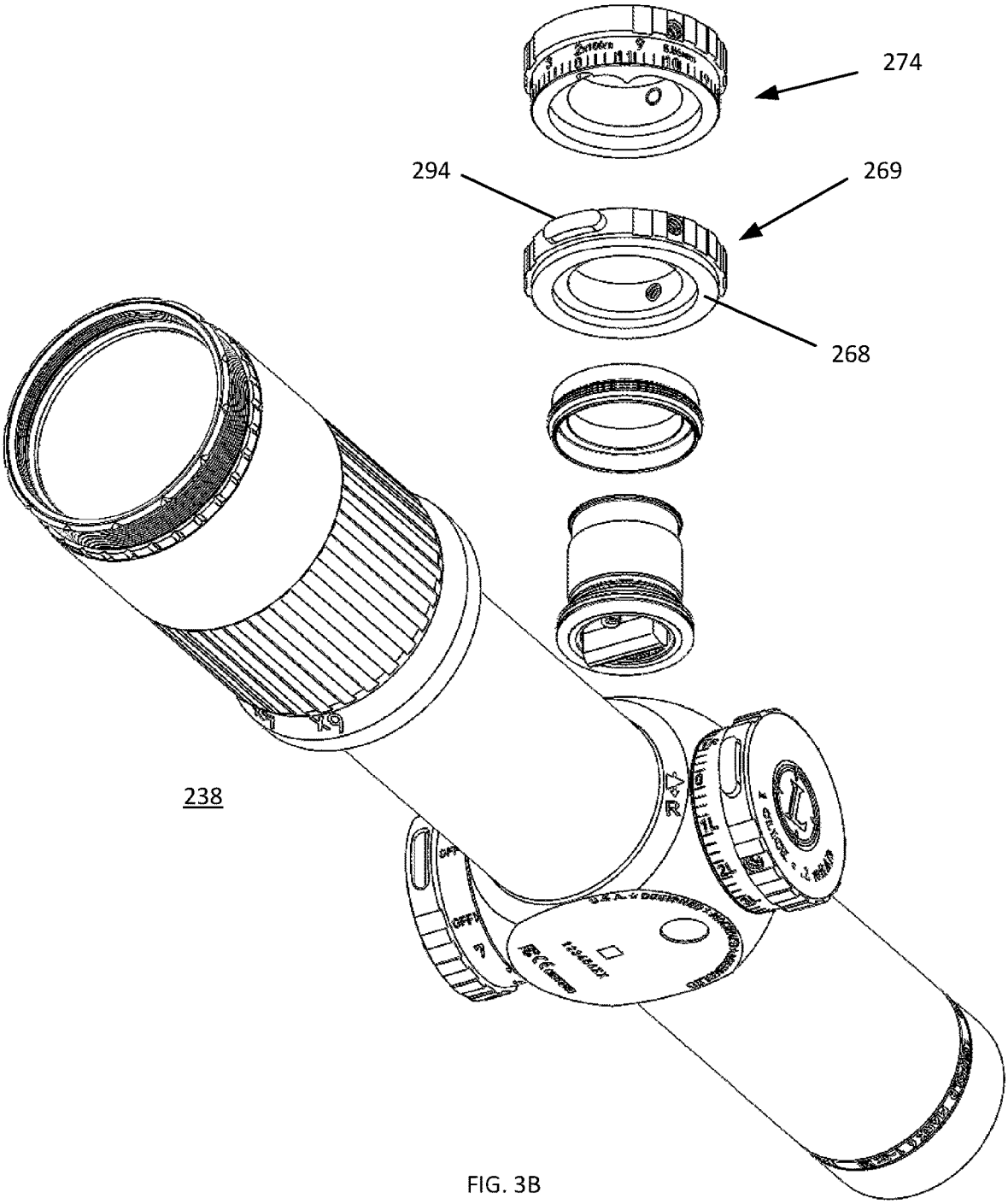
Figure 4A:
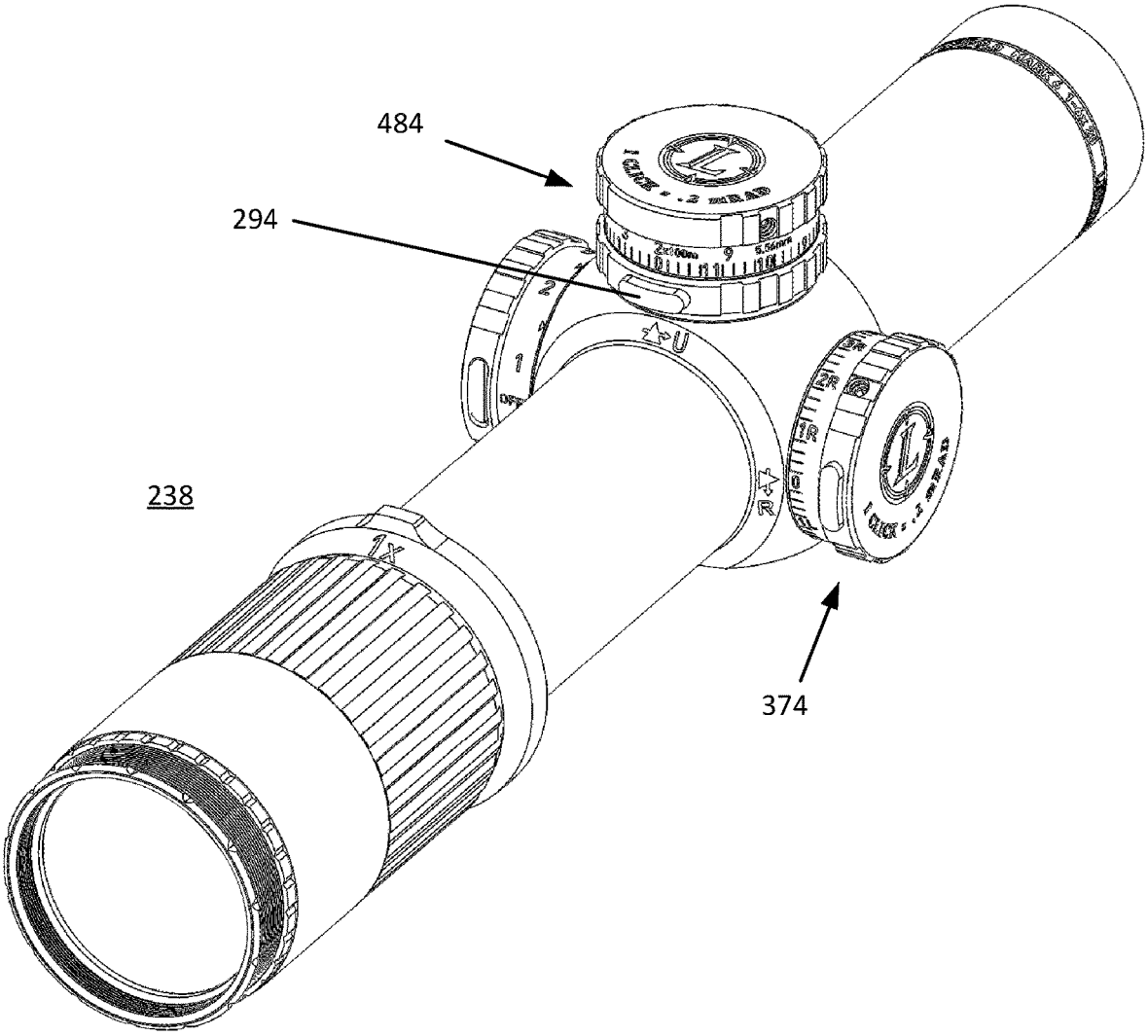
FIGS. 4A and 4B illustrate isometric views of the riflescope of FIGS. 2A and 2B in which the locking device is shown in locked and unlocked positions, respectively.
Figure 4B:
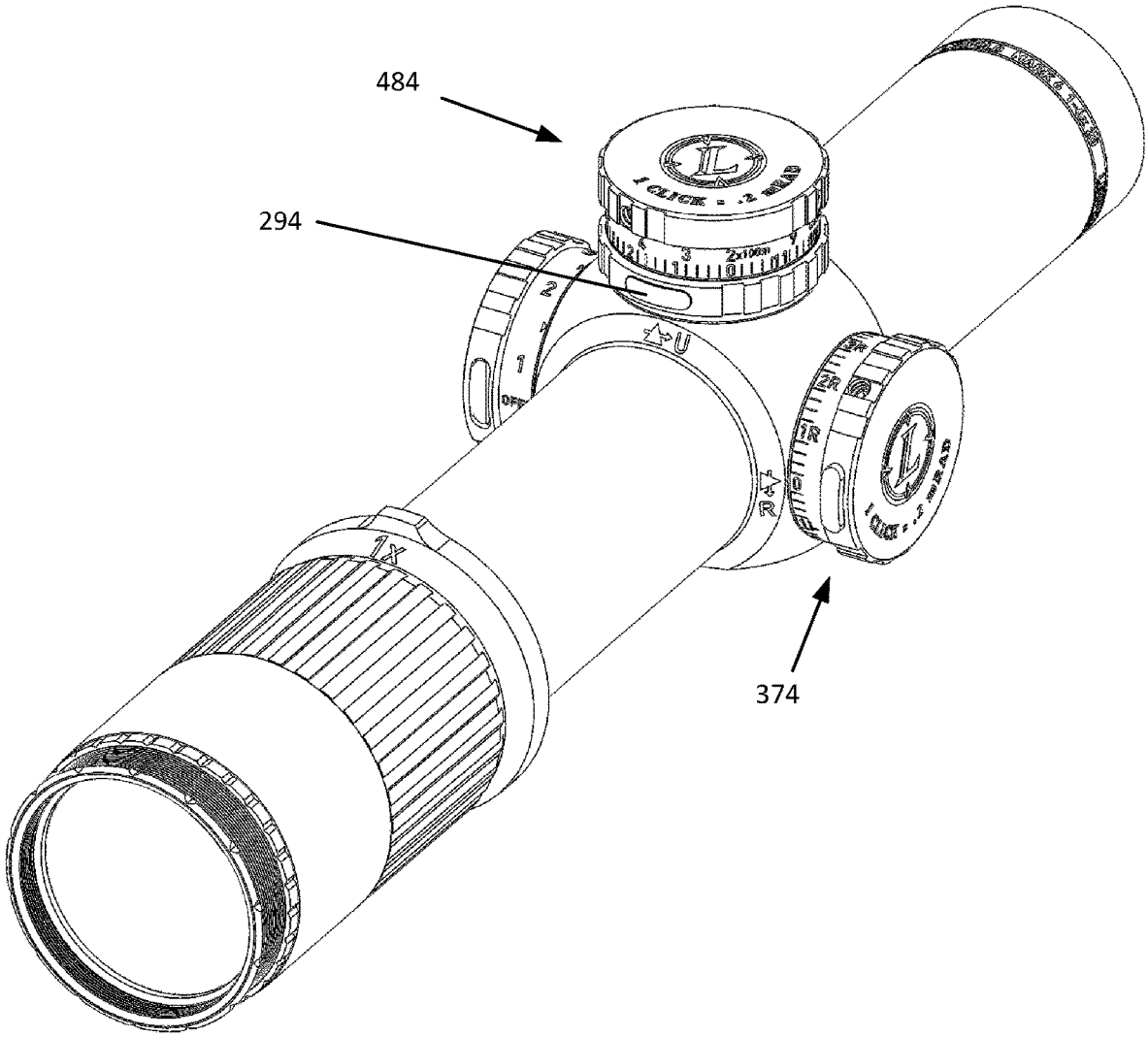

FIGS. 2A and 2B illustrate isometric views of a riflescope 238 having an adjustment assembly (including a knob assembly 274 and a catch assembly 269) coupled thereto, in which the adjustment assembly and its locking device are both shown in an exploded view, according to various embodiments. FIGS. 3A and 3B illustrate isometric views of the riflescope 238 of FIGS. 2A and 2B in which the adjustment assembly is shown in an exploded view with its locking device installed. FIGS. 4A and 4B illustrate isometric views of the riflescope 238 of FIGS. 2A and 2B in which the locking device is shown in locked and unlocked positions, respectively.

Figure 1:
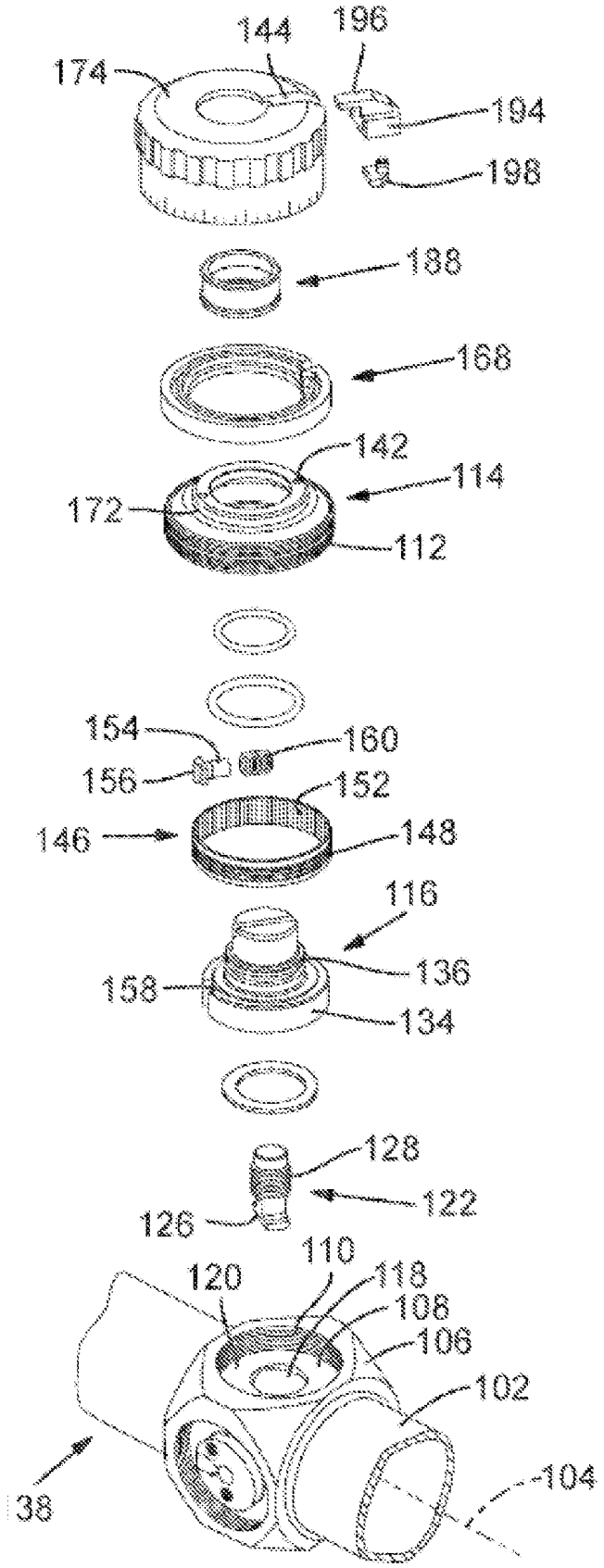
FIG. 1 illustrates an exploded view of a known locking adjustment device.

Referring to FIG. 2A, mounted to the main tube 202 of the riflescope 238 is a spindle assembly 216. The spindle assembly 216 may be similar in any respect to any known spindle assembly. For example, the spindle assembly 216 may include a retaining ring 214, a spindle 215 and a plunger 222 (FIG. 2B), which may be similar to retaining ring 114 (FIG. 1), spindle 116 (FIG. 1) and plunger 122 (FIG. 1). In this embodiment, retaining ring 114 surrounds spindle 215 and retains spindle 215 against a seat of the riflescope 138 (e.g., the threaded part of the retaining ring 114 threads into the threaded bore of the seat).

Mounted over the spindle assembly 216 is the adjustment assembly including the catch assembly 269 and the knob assembly 274 (in particular, the catch assembly 269 may be mounted onto the retaining ring 214 of the spindle assembly 216 whereas the knob assembly 274 may be mounted to the spindle 215 of the spindle assembly 216). The catch assembly 269 may include a ring 268 mountable onto the retaining ring 214 of the spindle assembly 216 (e.g., a ring opening of the ring 268 may receive an upper necked portion of the retaining ring 214 of the spindle assembly 216). In some embodiments, in addition to carrying the button 294 or other lock-release, the ring 268 may function as a guide ring-performing any of the functions as guide ring 168 (FIG. 1).

One or more surfaces of the ring 268 may include recesses to mate with locking assembly components. For example, in this embodiment an outer surface of the ring 268 defines an opening 248 (e.g., an aperture) in which a button 294 or other lock-release is located. In this embodiment, the opening 248 is similar to the aperture defined by the knob 174 (FIG. 1) in the '636 patent, and so constrains the button 294 or other lock-release to travel along a single axis. Also, an upper surface of the ring 268 may define a slot 244 or other recess in which the catch device 298 may be located.

The knob assembly 274 may be similar in any respect to the rotatable knob 174 described in the '636 patent. For example, in some embodiments the knob assembly 274 may include a retaining cap and dial (e.g., similar to the retaining cap and dial described in the description of FIG. 1 of the '636 patent), which may be fabricated as a single unitary part or may be formed from two separate components that are coupled together, such as via mating threads.

The knob assembly 274 may include a threaded bore 284 for a set screw (not shown), similar to the corresponding threaded bore described in the '636 patent. The set screw (not shown) insertable in the threaded bore 284 may be tightened so that knob assembly 274 and the spindle assembly 216 rotate together as a unit, or loosened so that the knob assembly 274 can be rotated relative to the spindle assembly 216. However, the set screw is not required—in other embodiments any knob assembly described herein may include any toolless actuation device usable by an operator to control whether the knob assembly 274 and the spindle assembly 216 rotate together (or not). In other embodiments, a knob assembly may include any rotatable knob, now known or later developed.

When the adjustable assembly is mounted to a sighting device (e.g., the riflescope 238 in this embodiment), the knob assembly 274 is rotatable relative to the sighting device (in the unlocked state, e.g., when the button 294 is depressed in this embodiment). In contrast, when the adjustable assembly is mounted to a sighting device, the catch assembly 269 is not rotatable relative to the sighting device (e.g., is rotationally fixed relative to the sighting device). Given the fixed rotation position of the catch assembly 269 when the adjustable assembly is mounted to a sighting device, it should be appreciated that travel of the button 294 or other lock-release may be constrained to a linear path (e.g., the button 294 or other lock-release travels along a linear path to and away from the turret axis, but does not rotate with the knob assembly 274). In other words, a rotational position of the button 294 or other lock-release is fixed relative to the sighting device. A fixed rotation position for the button 294 or other lock-release may allow some sighting device operators to lock or unlock rotation of the knob assembly 274 more easily.

The riflescope 238 is shown with a windage adjustment turret 374 having a knob similar to the knob 174 (FIG. 1) for case of comparison with the above described adjustment assembly of the elevation turret of the riflescope 238. It should be understood that in various embodiments a sighting device may have a knob assembly and catch assembly similar to knob assembly 274 and catch assembly 269, respectively, for any of its turrets such as its elevation adjustment turret and its windage adjustment turret.

In various embodiments, any spindle assembly or adjustment assembly described herein may include other components shown in FIG. 1, such as retaining ring 114, click mechanism, 146, click pin 154, and spring 160 or any other components now known, or later developed, to perform equivalent functions of these spindle and/or adjustment assembly components.

Figure 5A:
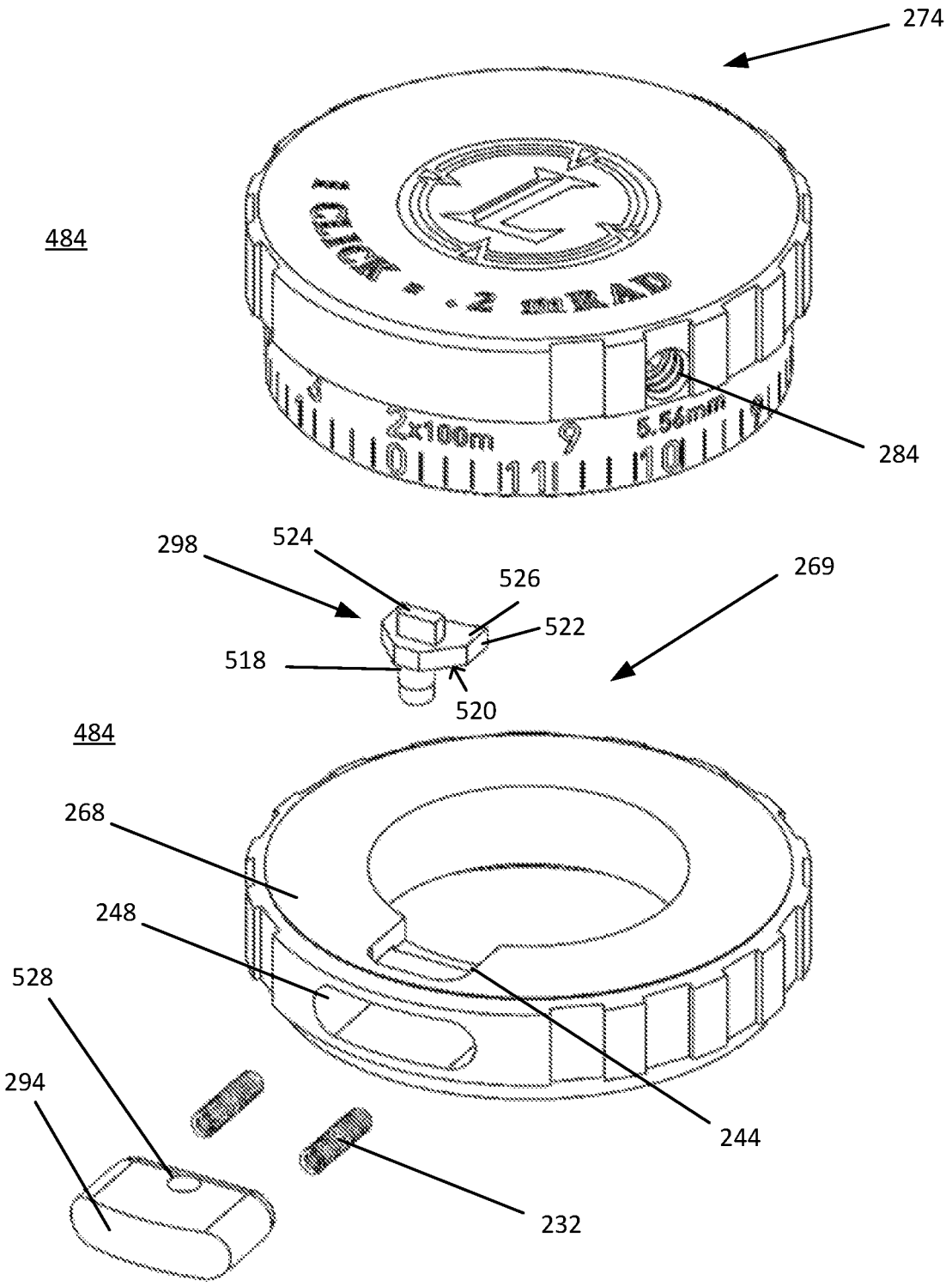
FIGS. 5A and 5B illustrate isometric views of the adjustment assembly of FIGS. 2A and 2B, in which the adjustment assembly and its locking device are both shown in an exploded view.
Figure 5B:
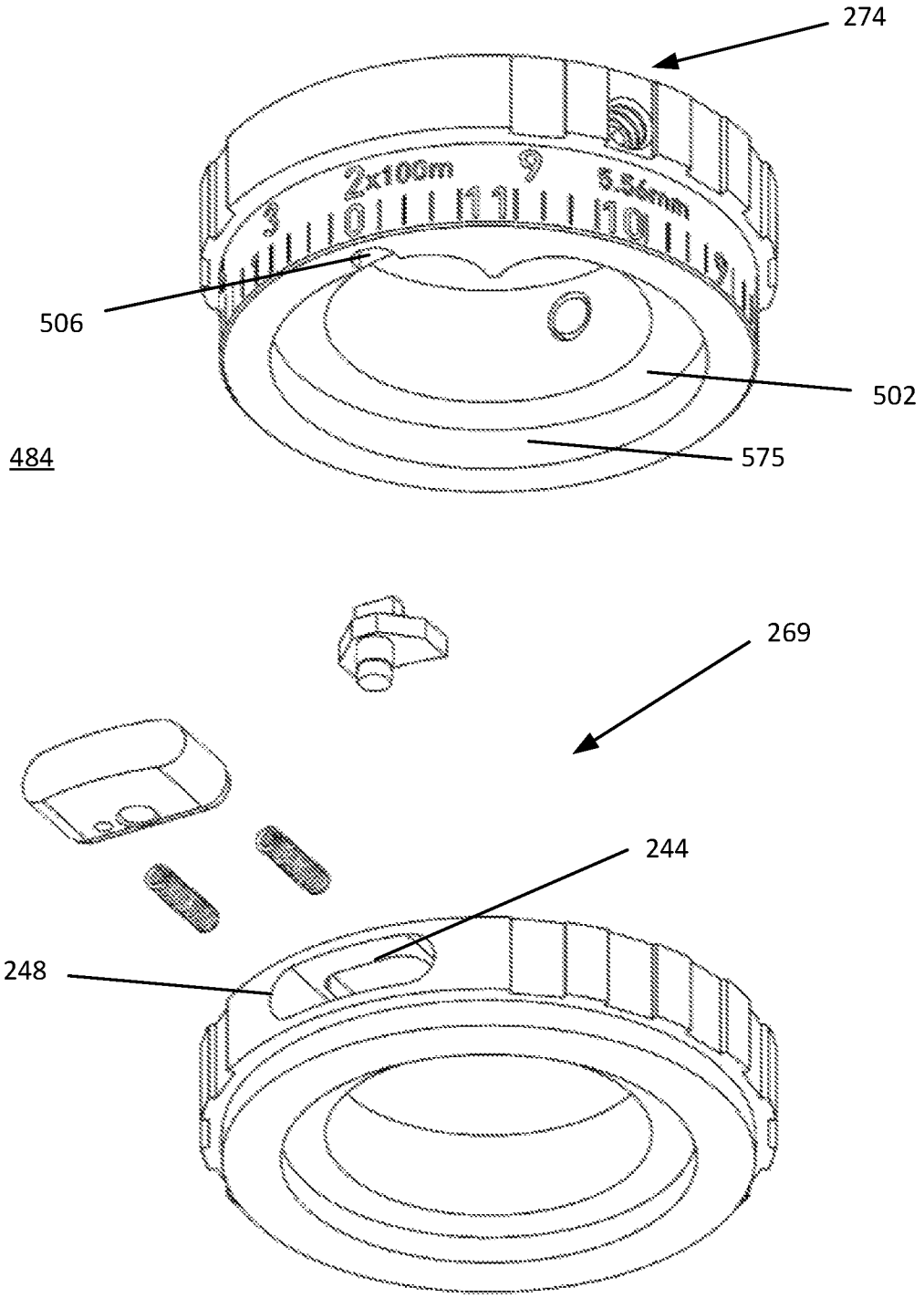
Figure 6A:
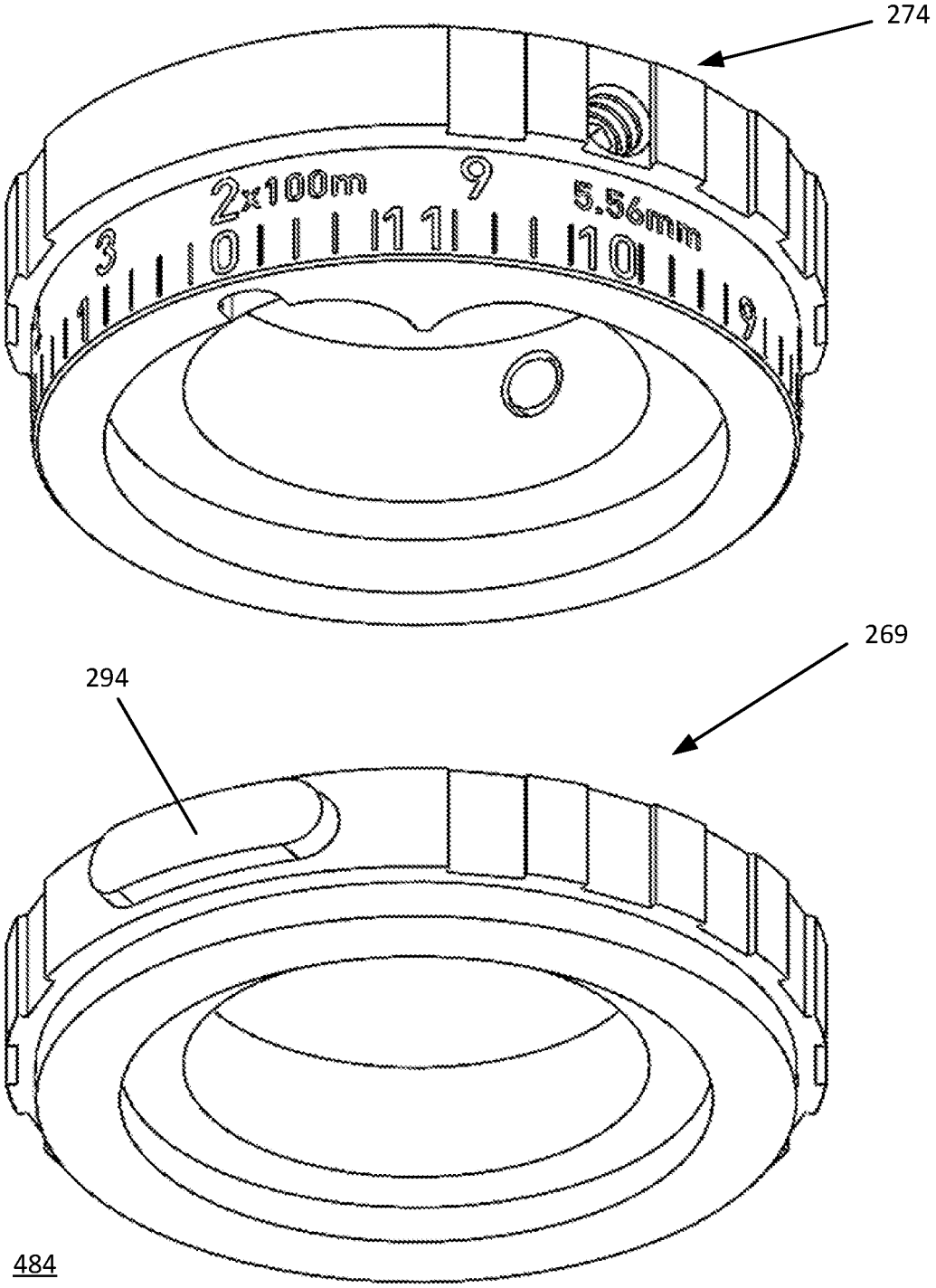
FIGS. 6A and 6B illustrate isometric views of the adjustment assembly of FIGS. 2A and 2B, in which the adjustment assembly is shown in an exploded view with its locking device installed.
Figure 6B:
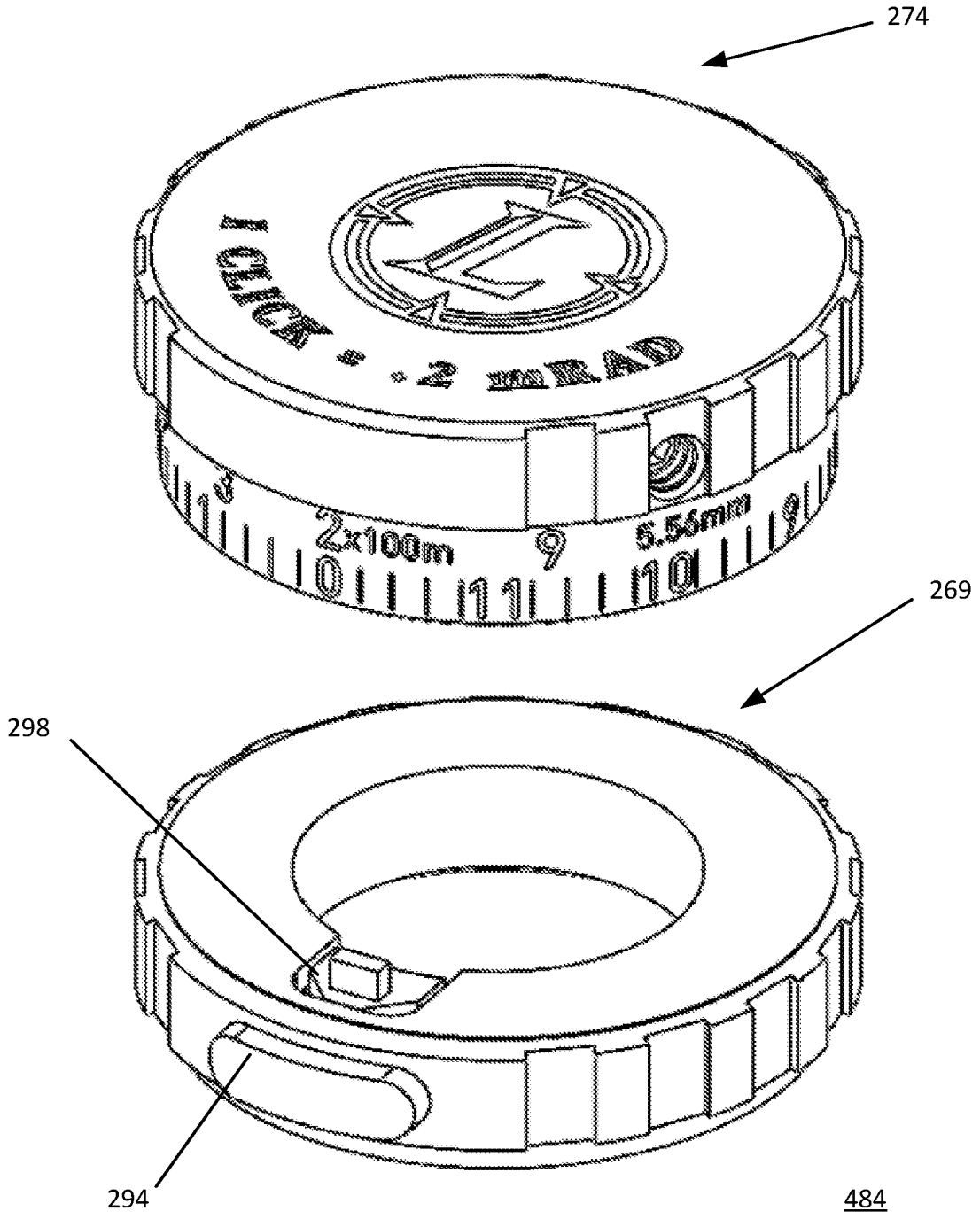
Figure 7A:
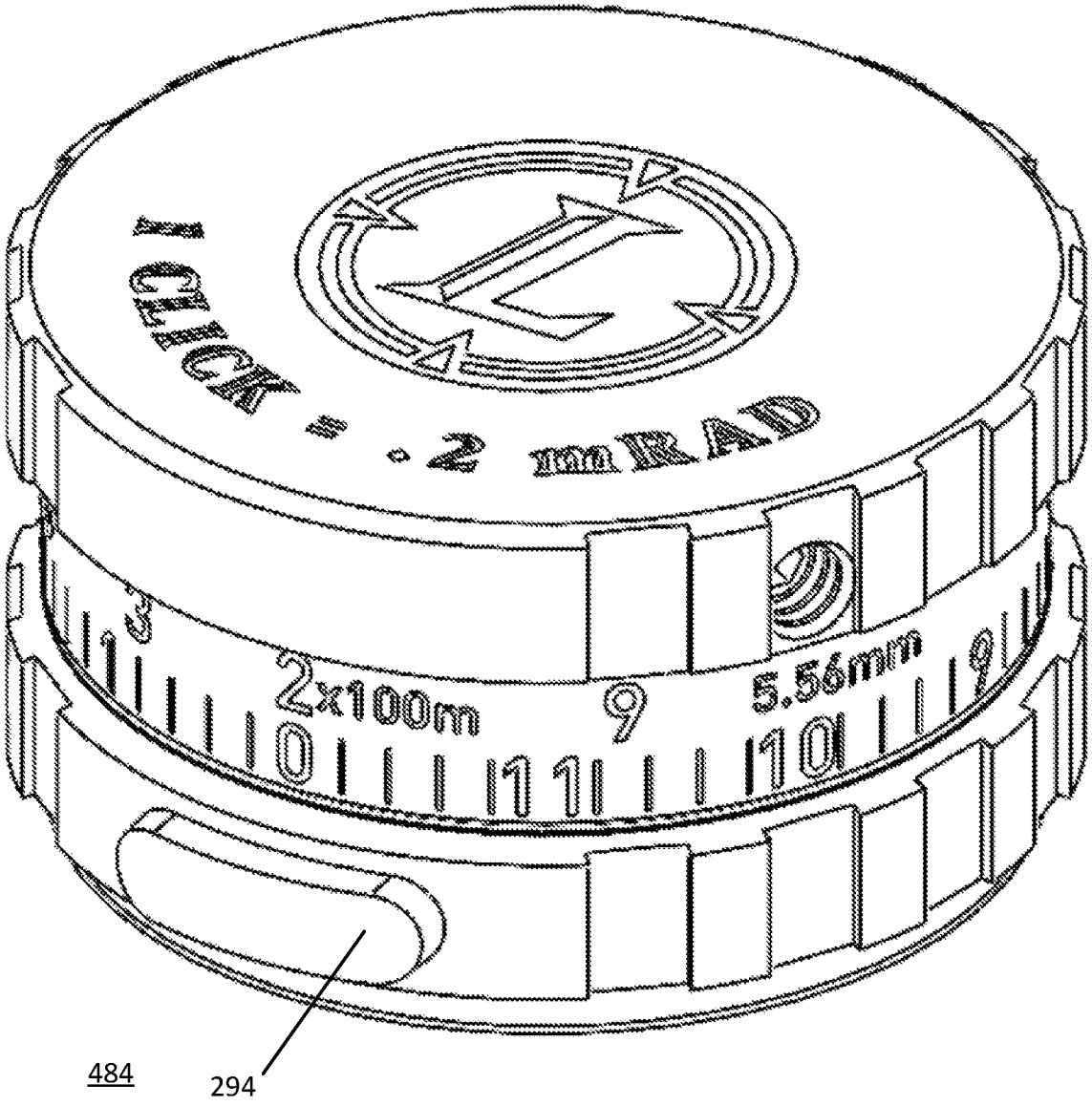
FIGS. 7A and 7B illustrate isometric views of the adjustment assembly of FIGS. 2A and 2B, in which the locking device is shown in locked and unlocked positions, respectively.
Figure 7B:
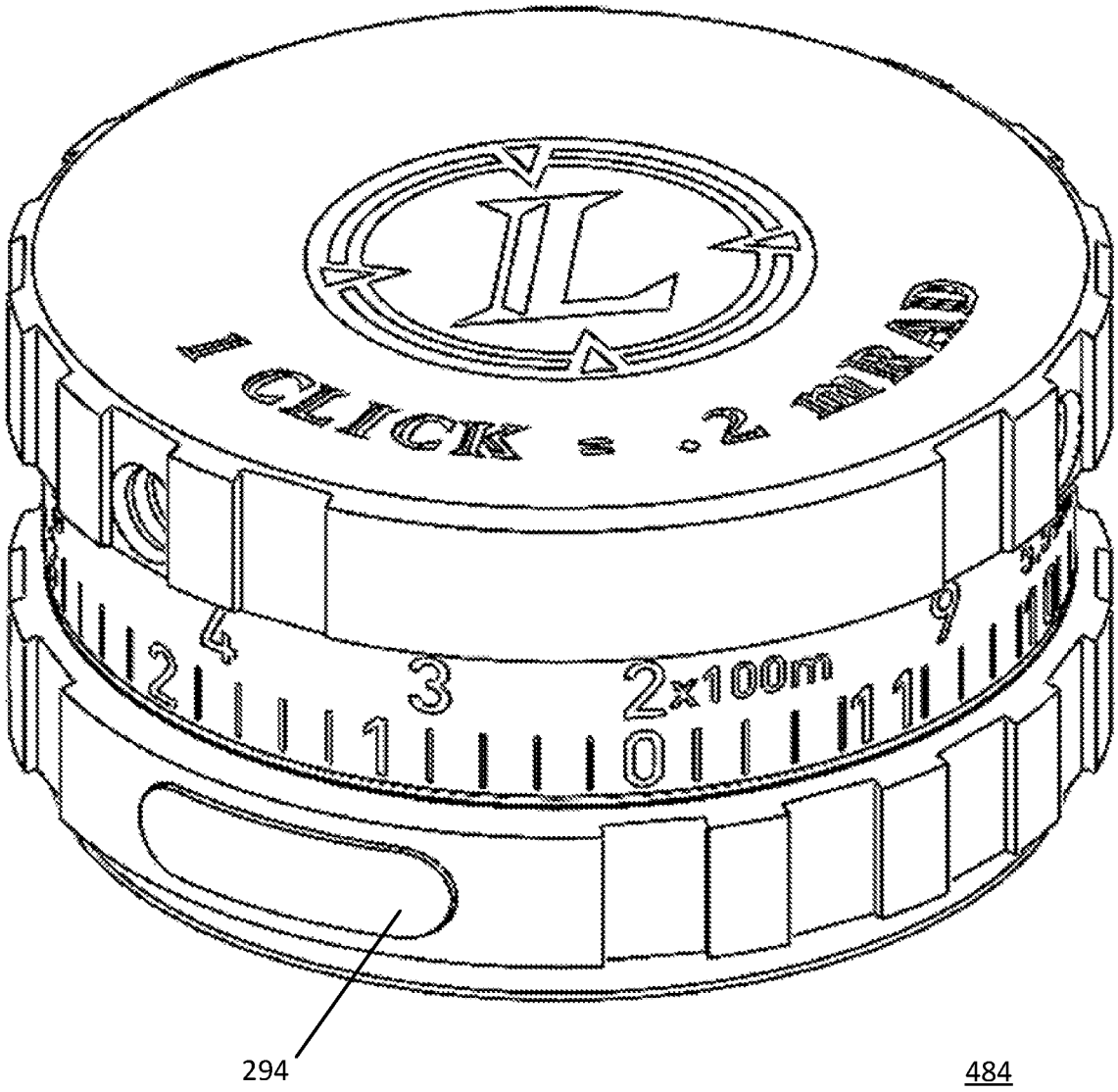

FIGS. 5A and 5B illustrate isometric views of the adjustment assembly of FIGS. 2A and 2B, in which the adjustment assembly and its locking device are both shown in an exploded view. FIGS. 6A and 6B illustrate isometric views of the adjustment assembly of FIGS. 2A and 2B, in which the adjustment assembly is shown in an exploded view with its locking device installed. FIGS. 7A and 7B illustrate isometric views of the adjustment assembly of FIGS. 2A and 2B, in which the locking device is shown in locked and unlocked positions, respectively Referring now to FIG. 5A, catch device 298 (e.g., a guide tab) may be similar in any respects to the guide tab 198 (FIG. 1). Referring now to FIG. 5A, the catch device 298 may include a fastening lower portion 518 (e.g., a tubular portion) extending from a bottom surface 520 of a body 522 (e.g., a planar or other thin body), and a catch member 524 (e.g., tabbed end) extending from an opposing top surface 526 of body 522. Catch device 298, via catch member 524 (e.g., a tabbed end), is slidably received by a guideway 502 (FIG. 5B) defined by a bottom of the knob assembly 274 (FIG. 5B) when the adjustment assembly is installed on spindle assembly 216 (FIG. 2A).

The guideway 502 (FIG. 5B) defined by the bottom of the knob assembly 274 may be similar to the guideway defined by the top of the guide ring 168 (FIG. 1). Catch member 524 is configured to travel along the guideway 502, riding against a curved slide surface 575 (extending around the turret axis) in response to rotation of knob assembly 274, similar to how guide tab 198 (FIG. 1) is configured to travel along the guideway defined by the top of the guide ring 168 (FIG. 1) in response to rotation of the knob 174 (FIG. 1).

In some embodiments, catch device 298 may be fixably attached (e.g., by press fit), or otherwise coupled to, the button 294 or other lock-release via the fastening portion 518 (e.g., tubular portion). A length of the fastening portion 518 (e.g., the tubular portion) of the catch device 298 may extend through a via defined at least in part by the top of the ring 268. Fastening portion 518 may be inserted into an opening 528 on button 294 having dimensions corresponding to fastening portion 518 and secured therein, such as by a press fit, using an adhesive, or the like. Alternatively, fastening portion 518 and opening 528 may both be threaded so that catch device 298 is threadably coupled to button 294 or other lock-release. In other embodiments, the catch device 298 and the button 294 or other lock-release may instead be formed as a single unitary piece.

A rear of the button 294 or other lock-release may define a pair of openings (not shown) to each receive a biasing element 232 (e.g., to receive a pair of springs). To unlock knob assembly 274, button 294 or other lock-release is depressed inwardly toward turret axis to urge catch member 524 out of a catch opening or recess (such as by a notch 506 defined by a bottom of the knob assembly 274—shown in FIG. 5B) and onto the curved slide surface 575 (defined by the bottom of the knob assembly 274—shown in FIG. 5B) near a first end of the curved slide surface 575 (FIG. 5B). From this position, knob assembly 274 may be manually rotated about turret axis away from the locked position. As knob assembly 274 is rotated (i.e., as the user is making a desired adjustment), catch member 524 rides away from the first end of the guideway 502 (FIG. 5B) and along the curved slide surface 575 (FIG. 5B).

In the illustrated embodiment, the adjustment assembly is a single revolution adjustment assembly, so the ramp at the end of the first turn may act as a stop. In other embodiments in which an adjustment assembly is arranged to make more than one revolution (e.g., a second revolution), an additional curved slide surface similar to the second curved slide surface described in the '636 patent may be provided on the bottom of the knob assembly similar to the second slide surface of the top of the guide ring described in the '636 patent. Briefly, in such an embodiment, once a knob has completed a rotation around the turret axis, the catch device (e.g., guide tab) may automatically transition onto the ramped transition section (defined by the bottom surface of the knob assembly) and continue on second curved surface to accommodate a second rotation of the knob. Depending on the shape of the transition section, the user may or may not feel a minor stop, bump, or other tactile sensation when catch device transitions between the curved slide curve and the additional curved slide surface. The user can continue turning knob until catch device hits a stop along the second end of the additional curved slide surface. At that point, in some embodiments the stop blocks catch device from moving beyond the second end, thereby limiting further rotation of the knob in this direction. The knob may still be rotated in an opposite direction for further fine adjustment and/or to return the knob assembly to its home position where it automatically locks.

In the illustrated embodiment, the retaining ring 214 (FIG. 2A) and the ring 268 (FIG. 2A) are formed from two separate components mountably coupled together (e.g., the ring 268 may be mounted on the separate retaining ring 214). However, given that both of these components may be stationary during operation of the adjustment assembly, it may be possible and practical to fabricate these rings as a single unitary ring or may be formed from two separate components that are fixably coupled together, such as via adhesive, press fit, or the like.

In other embodiments, any components described herein that rotate relative to each (or which do not rotate) may be fabricated as a single unitary structure. In another example of this, instead of providing a separable guide ring 268, in various embodiments guide ring features (e.g., any features defined by an upper section of the guide ring 268) may be integrally formed on the sighting device (e.g., machine into a main tube of a riflescope).

Figure 8A:
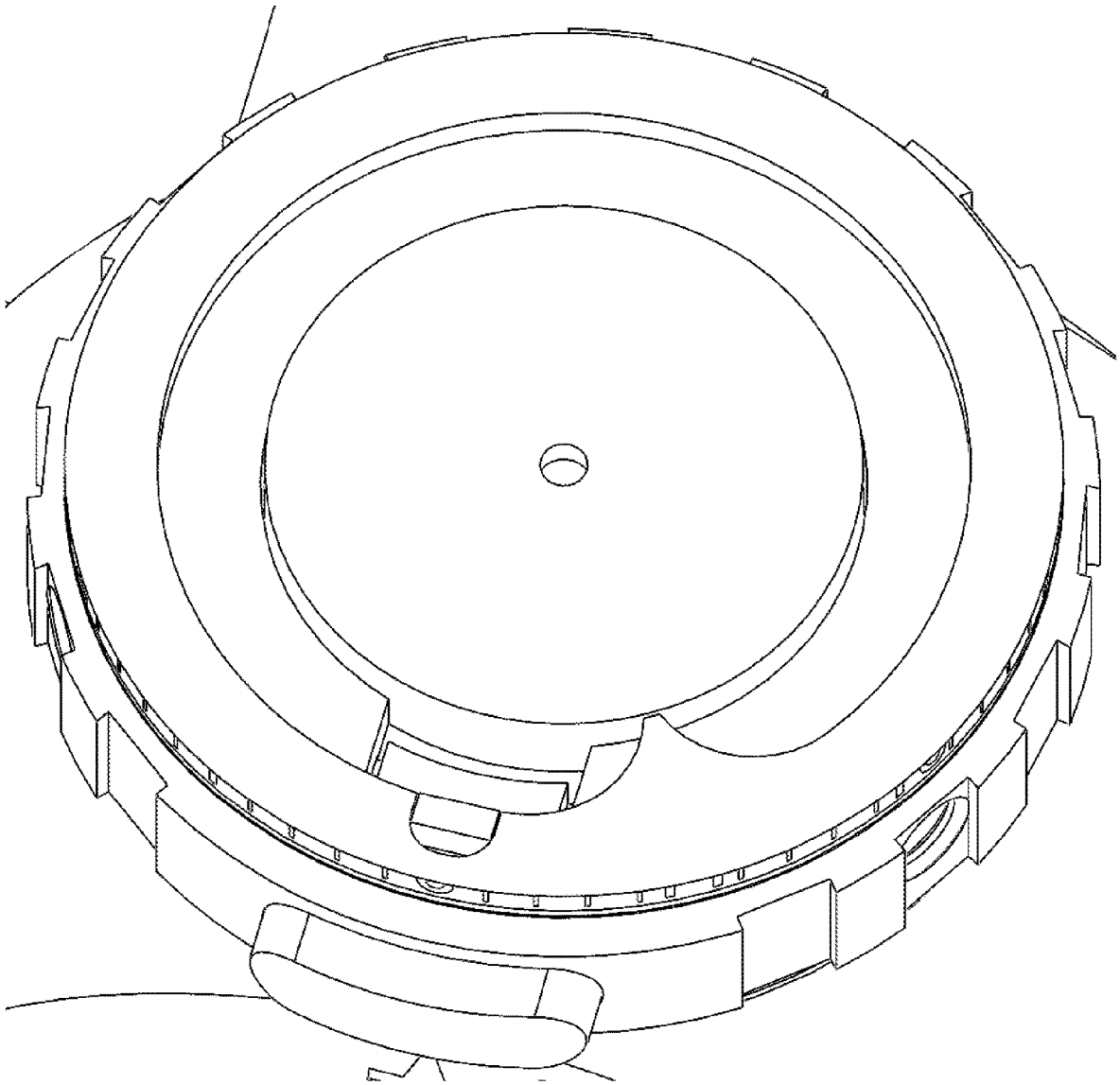
FIGS. 8A and 8B illustrate a cross section of an adjustment assembly similar to the adjustment assembly of FIGS. 2A and 2B, shown in its locked and unlocked positions, respectively.
Figure 8B:
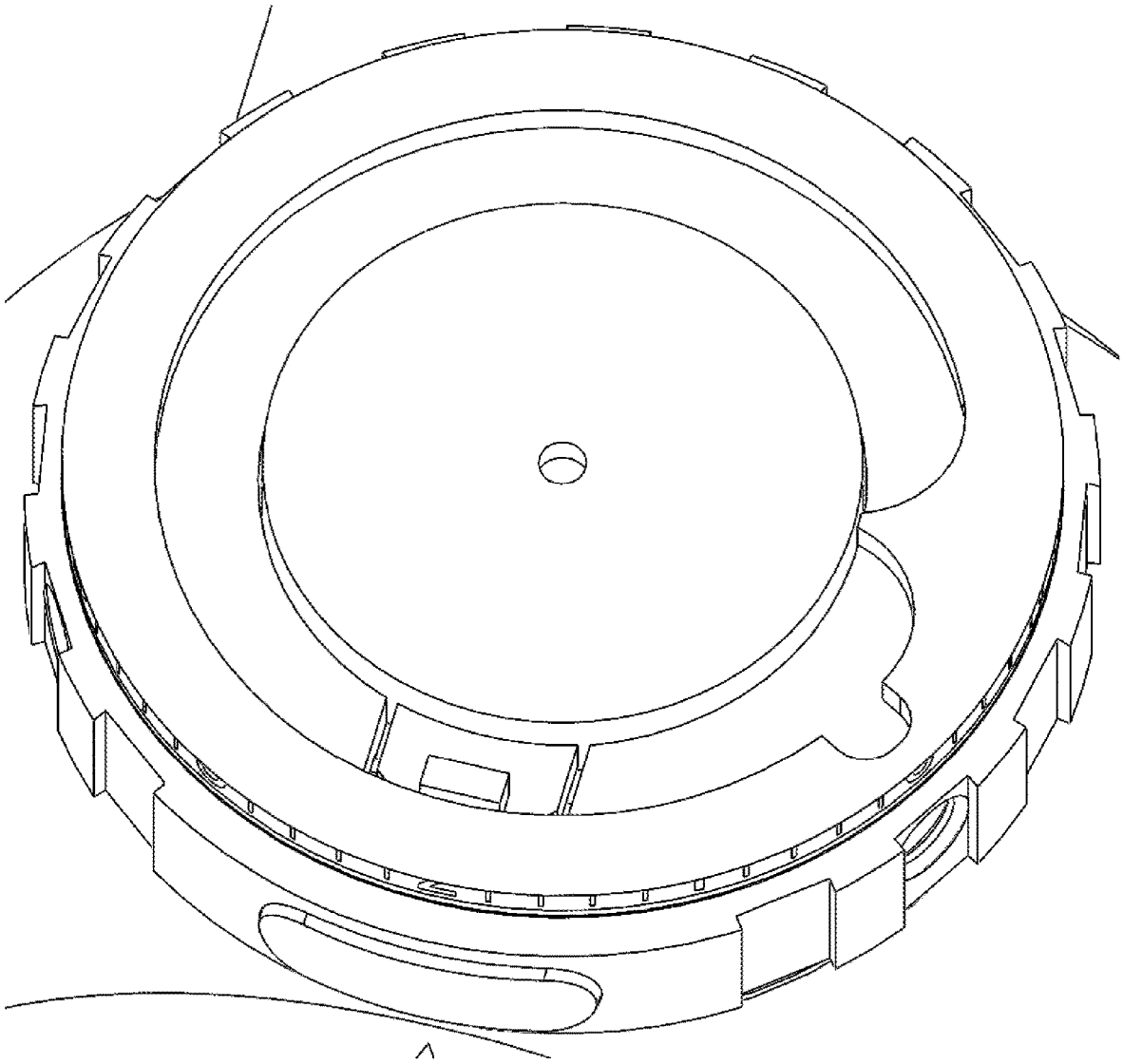

FIGS. 8A and 8B illustrate a cross section of an adjustment assembly similar to the adjustment assembly of FIGS. 2A and 2B, shown in its locked and unlocked positions, respectively. In FIG. 8A, a catch member projecting from an upper surface of a ring is located in a slot defined by a bottom of a knob assembly, which prevents the knob assembly from rotating until unlocked. To unlock the knob assembly (to allow it to rotate), the button may be depressed.

As the button is depressed, the catch member travels inwardly toward the turret axis, which urges the catch member out of the slot defined by the knob assembly. In this state, the adjustment assembly can be rotated in the counterclockwise. FIG. 8B illustrates a state following some counterclockwise rotation of the knob assembly.

In some embodiments, any knob assembly described herein may be rotatable from a home position in more than one direction (e.g., in clockwise and counterclockwise directions), when unlocked. In other embodiments, it may be possible and practical to restrict rotation of any knob assembly described herein to rotation from the home position in a single direction, when unlocked.

Any assembly described herein may be formed from a set of parts including a single unitary part or more than one part. For sets containing more than one part, the parts may be fixably coupled together (e.g., press fit), releasably coupled together, or the like, or combinations thereof. As one example, as described earlier, a knob assembly may include a retaining cap and a dial coupled together, or may include a single unitary part (such as a knob having an upper section similar in any respect to the retaining cap and a lower section similar in any respect to the dial).

In the illustrated embodiment, the button or other lock-release is part of the adjustment assembly. In other embodiments, any of the principles described herein may be used to locate a button or other lock-release on some other part of a sighting device. For example, in some embodiments, a seat of the sighting device may define an opening to receive a fixed rotational position button or other lock-release. In various embodiments, any components of any catch assembly described herein may be part of a sighting device (e.g., located below the turret).

In still other embodiments, a button or other lock-release may be carried by the knob assembly. For example, in such an embodiment an axis of the button or other lock-release may coincide with the turret axis (co-axial axes). In such an embodiment, while the button or other lock-release may rotate about its axis, its lateral and longitudinal location relative to the sighting device does not change (e.g., the button or other lock-release has a fixed lateral and longitudinal location). In various embodiments, the button or other lock-release may be arranged to travel inwardly along a linear path.

It will be obvious to those having skill in the art that many changes may be made to the details of the above-described embodiments without departing from the underlying principles of the invention. The scope of the present invention should, therefore, be determined only by the following claims.

The invention claimed is:

1. An apparatus, comprising:

a locking adjustment device including:

a knob assembly graspable by a user, the knob assembly being manually rotatable about a rotational axis, to adjust an optical device setting;

a catch assembly defining a home position of the knob assembly whereat the catch assembly prevents rotation of the knob assembly in a clockwise or counterclockwise direction; and wherein the catch assembly includes a button or other lock-release arranged to, responsive to a manually-applied force, disengage a catch member from a catch opening or recess to allow the knob assembly to be rotated, in the clockwise or counterclockwise direction and relative to the button or other lock-release, from the home position to an adjustment position.

2. The apparatus of claim 1, wherein one of the knob assembly and the catch assembly defines the catch opening or recess, and the catch member is part of, or fixably coupled to, the other of the knob assembly and the catch assembly.

3. The apparatus of claim 1, wherein the button or other lock-release is separate from the knob assembly, and manual rotation of the knob assembly moves the knob assembly relative to the button or other lock-release.

4. The apparatus of claim 1, wherein the locking adjustment device is arranged to constrain travel of the button or other lock-release to a linear path.

5. The apparatus of claim 1, wherein the button or other lock-release is part of the catch assembly and is arranged to travel within an opening defined by the catch assembly.

6. The apparatus of claim 1, wherein the catch member is fixably coupled to, or integrally formed with, the button or other lock-release.

7. The apparatus of claim 1, wherein the catch assembly includes a ring defining a ring opening through which the knob assembly is operatively couplable to a spindle assembly.

8. A sighting device including the locking adjustment device of claim 1.

9. A riflescope or other aimed optical device comprising the sighting device of claim 8.

10. The sighting device of claim 8, further comprising seat having a bore sized to receive the locking adjustment device.

11. An apparatus, comprising:

a locking adjustment device including:

a rotatable assembly graspable by a user, the rotatable assembly being manually rotatable about a turret axis to adjust an optical device setting; and a catch assembly defining a home position of the rotatable assembly whereat the catch assembly prevents rotation of the rotatable assembly relative to the sighting device in a clockwise or counterclockwise direction;

wherein the locking adjustment device includes a button or other lock-release arranged to, responsive to a manually-applied force, travel along a linear path and disengage a catch member from a catch opening or recess to allow the rotatable assembly to be rotated, in the clockwise or counterclockwise direction, from the home position to an adjustment position; and wherein the button or other lock-release is separate from the rotatable assembly, and rotation of the rotatable assembly moves the rotatable assembly relative to the button or other lock-release.

12. The apparatus of claim 11, wherein the button or other lock-release travels along the linear path responsive to the manually-applied force.

13. The apparatus of claim 12, wherein the linear path is non-parallel with a turret axis.

14. The apparatus of claim 11, wherein one of the rotatable assembly and the catch assembly defines the catch opening or recess, and the catch member is part of, or fixably coupled to, the other of the knob assembly and the catch assembly.

15. The apparatus of claim 11, wherein the button or other lock-release is separate from the rotatable assembly, and rotation of the rotatable assembly moves the rotatable assembly relative to the button or other lock-release.

16. An apparatus, comprising:

a locking adjustment device including:

a rotatable assembly graspable by a user, the rotatable assembly being manually rotatable about a turret axis to adjust an optical device setting; and a catch assembly defining a home position of the rotatable assembly whereat the catch assembly prevents rotation of the rotatable assembly relative to the sighting device in a clockwise or counterclockwise direction;

wherein the locking adjustment device includes a button or other lock-release arranged to, responsive to a manually-applied force, disengage a catch member from a catch opening or recess to allow the rotatable assembly to be rotated, in the clockwise or counterclockwise direction, from the home position to an adjustment position; and wherein:

the rotatable assembly rotates relative to the button or other lock-release, or the button or other lock release does not travel during rotation of the rotatable assembly from the home position to the adjustment position.

17. The apparatus of claim 16, wherein the button or other lock-release travels along a linear path responsive to the manually-applied force.

18. The apparatus of claim 17, wherein the linear path is non-parallel with the turret axis.

19. The apparatus of claim 16, wherein one of the rotatable assembly and the catch assembly defines the catch opening or recess, and the catch member is part of, or fixably coupled to, the other of the knob assembly and the catch assembly.

20. The apparatus of claim 16, wherein the catch assembly includes a ring defining a ring opening through which the knob assembly is operatively couplable to a spindle assembly.

* * * * *